US010745842B2

(12) United States Patent
Hettinger et al.

(10) Patent No.: US 10,745,842 B2
(45) Date of Patent: Aug. 18, 2020

(54) WASHING MACHINE APPLIANCES AND METHODS FOR OPERATING THE SAME

(71) Applicant: General Electric Company, Schenectady, NY (US)

(72) Inventors: Stephen Edward Hettinger, Louisville, KY (US); Gary Lester Chastine, Louisville, KY (US); Ryan Ellis Leonard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1110 days.

(21) Appl. No.: 14/222,719

(22) Filed: Mar. 24, 2014

(65) Prior Publication Data

US 2015/0267341 A1 Sep. 24, 2015

(51) Int. Cl.

| | |
|---|---|
| ***D06F 23/04*** | (2006.01) |
| ***D06F 33/02*** | (2006.01) |
| ***D06F 35/00*** | (2006.01) |
| *D06F 33/00* | (2020.01) |

(52) U.S. Cl.

CPC ..... *D06F 35/005* (2013.01); *D06F 23/04* (2013.01); *D06F 33/00* (2013.01); *D06F 2204/088* (2013.01)

(58) Field of Classification Search

CPC ..... D06F 23/04; D06F 33/02; D06F 35/005; D06F 35/006; D06F 2204/065; D06F 2204/088; D06F 2232/06

USPC ..... 8/158, 159; 68/12.05, 23.5

See application file for complete search history.

(56) References Cited

U.S. PATENT DOCUMENTS

| | | | | |
|---|---|---|---|---|
| 4,031,911 | A * | 6/1977 | Frazar | D06F 39/045 137/3 |
| 5,167,722 | A | 12/1992 | Pastryk et al. | |
| 2004/0261194 | A1* | 12/2004 | Price | C11D 3/0015 8/137 |
| 2006/0143837 | A1* | 7/2006 | McIllwain | D06F 35/006 8/158 |
| 2007/0067920 | A1* | 3/2007 | Zaccone | D06F 25/00 8/158 |
| 2007/0169282 | A1* | 7/2007 | Kim | D06F 39/008 8/158 |
| 2008/0271262 | A1 | 11/2008 | Kang | |
| 2010/0235999 | A1* | 9/2010 | Moschutz | D06F 35/006 8/137 |

(Continued)

FOREIGN PATENT DOCUMENTS

| | | |
|---|---|---|
| DE | 3523824 | 2/1987 |
| WO | WO2013/083434 | 6/2013 |

*Primary Examiner* — Levon J Shahinian
(74) *Attorney, Agent, or Firm* — Dority & Manning, P.A.

(57) ABSTRACT

Washing machine appliances and methods for operating washing machine appliances are provided. A washing machine appliance has a tub and a basket rotatably mounted within the tub, the basket defining a chamber for receipt of articles for washing. A method includes spraying an initial rinse volume of water into the tub, the water at a cold temperature. The method further includes rotating the articles within the tub, and spinning the articles within the tub. The method further includes spraying a final rinse volume of water into the tub, the water at a temperature greater than the cold temperature. The method further includes rotating the articles within the tub, and spinning the articles within the tub.

11 Claims, 3 Drawing Sheets

(56) References Cited

U.S. PATENT DOCUMENTS

2010/0325815 A1* 12/2010 Im ..... D06F 33/02
8/159
2012/0193985 A1* 8/2012 Kim ..... D06F 33/02
307/35

* cited by examiner

WASHING MACHINE APPLIANCES AND METHODS FOR OPERATING THE SAME

FIELD OF THE INVENTION

The present subject matter relates generally to washing machine appliances and methods for operating washing machine appliances.

BACKGROUND OF THE INVENTION

Washing machine appliances generally include a tub for containing wash fluid, e.g., water and detergent, bleach and/or other wash additives. A basket is rotatably mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

Many traditionally known washing machine appliances have utilized a "deep fill" rinse process to rinse articles therein. A deep fill rinse process involves, after the main wash cycle is completed, filling the tub with a substantial volume of water that is sufficient to generally submerge a majority of the articles within the tub. The articles are then agitated within the water, after which the water is drained and the basket is spun to wring excess water/wash fluid from the articles. Additionally, many washing machine appliances included a warm rinse feature. When the warm rinse feature is enabled, the substantial volume of water that fills the tub during the deep fill rinse process is at a warm temperature, such that the resulting articles at the conclusion of the deep fill rinse process feel warm to the consumer. This increases the user's positive perception of the wash process generally.

However, recent governmental regulations with regard to energy usage in home appliances have resulted in curtailment of the deep fill rinse process. The use of the substantial volume of warm water during a warm deep fill rinse in particular would result in heavy energy usage penalties under current regulation metrics, so these options are no longer available on many washing machine appliances. However, many customers continue to desire a wash process that results in warm articles.

Accordingly, improved washing machine appliances and methods for operating washing machine appliances are desired in the art. In particular, appliances and methods which include features which result in warm articles at the conclusion of the wash process, while not exceeding energy standard limitations, would be advantageous.

BRIEF DESCRIPTION OF THE INVENTION

In accordance with one embodiment of the present disclosure, a method for operating a washing machine appliance is provided. The washing machine appliance has a tub and a basket rotatably mounted within the tub, the basket defining a chamber for receipt of articles for washing. The method includes spraying an initial rinse volume of water into the tub, the water at a cold temperature. The method further includes rotating the articles within the tub during the step of spraying the initial rinse volume of water into the tub, and spinning the articles within the tub after the step of spraying the initial rinse volume of water into the tub. The method further includes spraying a final rinse volume of water into the tub, the water at a temperature greater than the cold temperature. The method further includes rotating the articles within the tub during the step of spraying the final rinse volume of water into the tub, and spinning the articles within the tub after the step of spraying the final rinse volume of water into the tub.

In accordance with another embodiment of the present disclosure, a washing machine appliance is provided. The washing machine appliance includes a tub, and a basket rotatably mounted within the tub, the basket defining a wash chamber for receipt of articles for washing. The washing machine appliance further includes a main valve in fluid communication with an external water source, a nozzle configured for flowing liquid from the valve into the tub, and a motor in mechanical communication with the basket, the motor configured for selectively rotating the articles within the tub. The washing machine appliance further includes a controller in operative communication with the valve and the motor. The controller is operable for spraying an initial rinse volume of water into the tub, the water at a cold temperature. The controller is further operable for rotating the articles within the tub during the step of spraying the initial rinse volume of water into the tub, and spinning the articles within the tub after the step of spraying the initial rinse volume of water into the tub. The controller is further operable for spraying a final rinse volume of water into the tub, the water at a temperature greater than the cold temperature. The controller is further operable for rotating the articles within the tub during the step of spraying the final rinse volume of water into the tub, and spinning the articles within the tub after the step of spraying the final rinse volume of water into the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
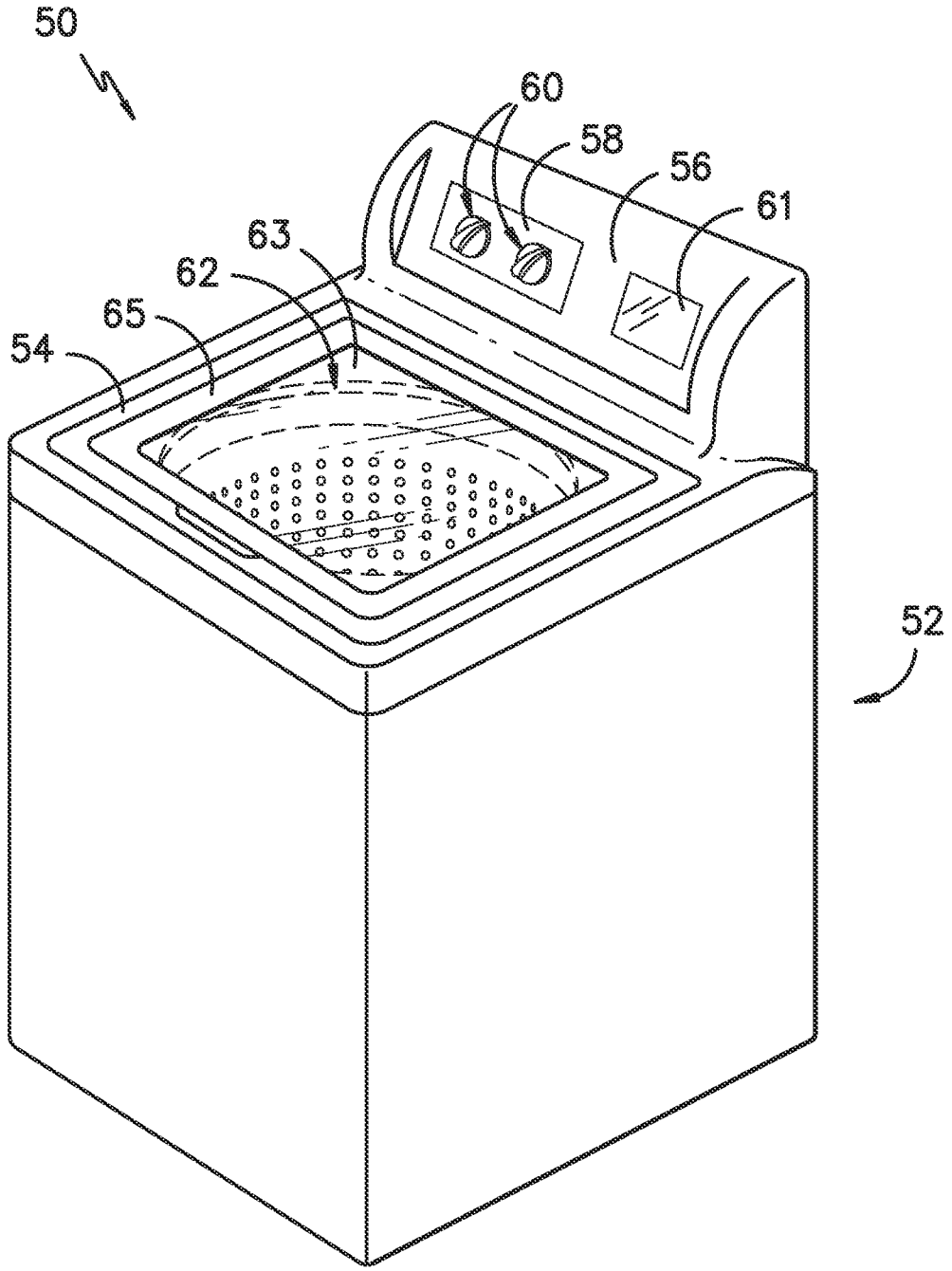
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIGS. 2 and 3) located within cabinet 52 and a closed position (shown in FIG. 1) forming an enclosure over tub 64.

Lid 62 in exemplary embodiment includes a transparent panel 63, which may be formed of for example glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
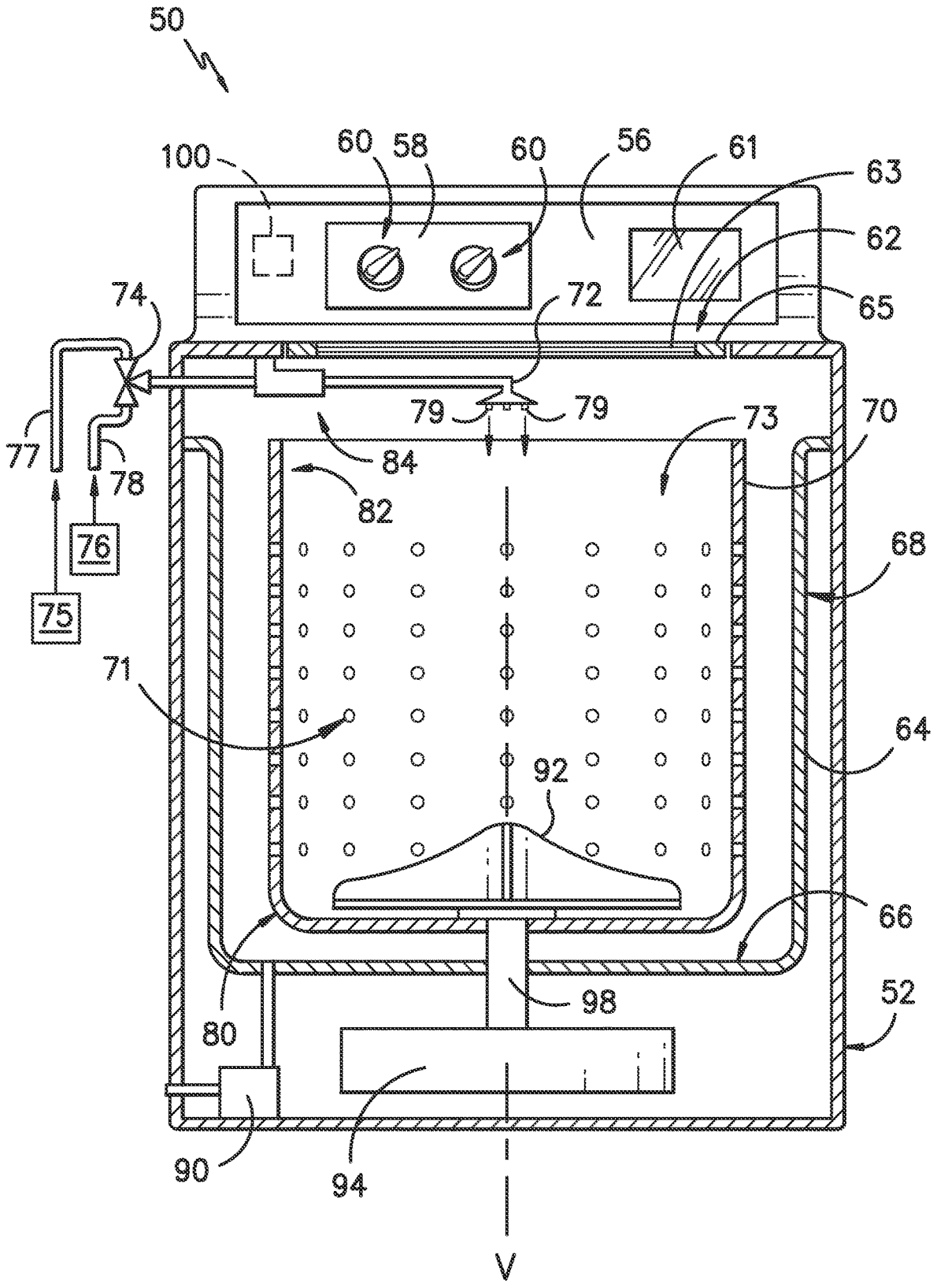
FIG. 2 provides a front, section view of a washing machine appliance in accordance with one embodiment of the present disclosure.

FIG. 2 provides a front, cross-section views of washing machine appliance 50. As may be seen in FIG. 2, tub 64 includes a bottom wall 66 and a sidewall 68. A wash drum or wash basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 75, 76 in order to direct liquid (e.g. water) into tub 64 and/or onto articles within chamber 73 of basket 70. Nozzle 72 may further include apertures 79 through which water may be sprayed into the tub 64. Apertures 79 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

A main valve 74 regulates the flow of fluid through nozzle 72. For example, valve 74 can selectively adjust to a closed position in order to terminate or obstruct the flow of fluid through nozzle 72. The main valve 74 may be in fluid communication with one or more external water sources, such as a cold water source 75 and a hot water source 76. The cold water source 75 may, for example, be a commercial water supply, while the hot water source 76 may be, for example, a water heater. Such external water sources 75, 76 may supply water to the appliance 50 through the main valve 74. A cold water conduit 77 and a hot water conduit 78 may supply cold and hot water, respectively, from the sources 75, 76 through valve 74. Valve 74 may further be operable to regulate the flow of hot and cold liquid, and thus the temperature of the resulting liquid flowed into tub 64, such as through the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. In some embodiments, nozzle 72 is a separate downstream component from dispenser 84. In other embodiments, nozzle 72 and dispenser 84 may be integral, with a portion of dispenser 84 serving as the nozzle 72. A pump assembly 90 (shown schematically in FIG. 2) is located beneath tub 64 and basket 70 for gravity assisted flow to drain tub 64.

An agitation element 92, shown as an impeller in FIG. 2, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Basket 70 and agitation element 92 are driven by a motor 94, such as a pancake motor. As motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as main valve 74, motor 94, etc. In response to user manipulation of the input selectors 60, controller 100 may operate the various components of washing machine appliance 50 to execute selected machine cycles and features.

Controller 100 may include a memory and microprocessor, such as a general or special purpose microprocessor operable to execute programming instructions or microcontrol code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

In an illustrative embodiment, laundry items are loaded into chamber 73 of basket 70, and washing operation is initiated through operator manipulation of control input selectors 60. Tub 64 is filled with water and mixed with detergent to form a liquid or wash fluid. Main valve 74 can be opened to initiate a flow of water into tub 64 via nozzle 72, and tub 64 can be filled to the appropriate level for the amount of articles being washed. Once tub 64 is properly filled with wash fluid, the contents of the basket 70 are agitated with agitation element 92 for cleaning of articles in basket 70. More specifically, agitation element 92 is moved back and forth in an oscillatory motion.

After the agitation phase of the wash cycle is completed, tub 64 is drained. Laundry articles can then be rinsed by again adding fluid to tub 64, depending on the particulars of the cleaning cycle selected by a user, agitation element 92 may again provide agitation within basket 70. One or more spin cycles may also be used. In particular, a spin cycle may be applied after the wash cycle and/or after the rinse cycle in order to wring wash fluid from the articles being washed. During a spin cycle, basket 70 is rotated at relatively high speeds.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
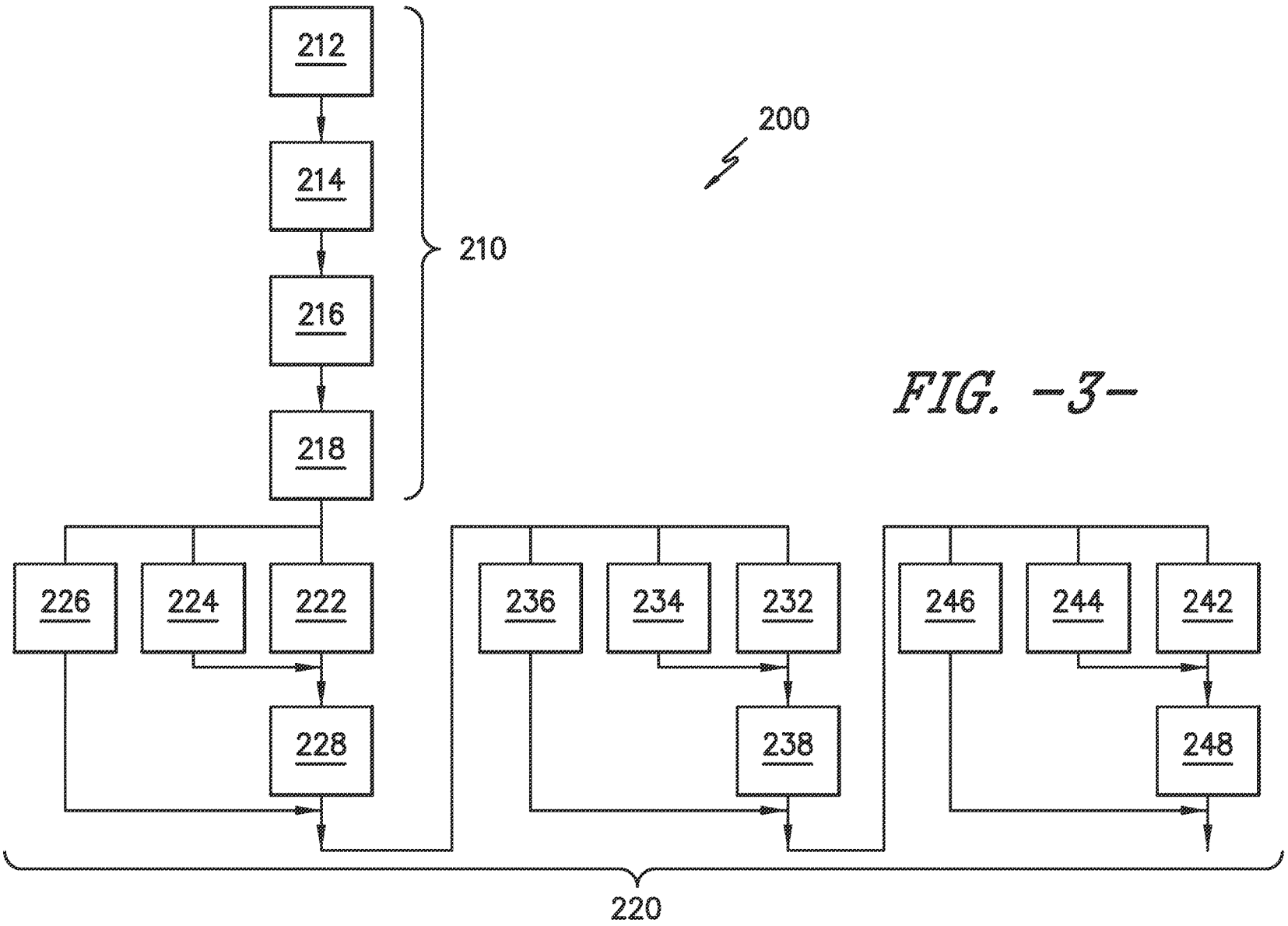
FIG. 3 provides a flow chart of an exemplary method for operating a washing machine appliance according to an exemplary embodiment of the present subject matter.

Referring now to FIG. 2 as well as FIG. 3, the present disclosure is further directed to methods for operating washing machine appliances 50 which advantageously provide warm articles at the conclusion of the wash process. Such methods further advantageously provide such warm articles in an energy efficient manner, within the required energy regulations for washing machine appliances 50. The present disclosure further is directed to washing machine appliances 50 which include controllers 100 operable to perform, and thus direct the various components of the appliances 50 to perform, the various steps as disclosed herein.

Accordingly, a method 200 according to the present disclosure may include the step 210 of performing a main wash cycle. The main wash cycle may generally include any suitable steps which may provide main cleaning of the articles within the tub 64. For example, step 200 may include the step 212 of flowing a wash volume of water into the tub 64. The wash volume may be combined with one or more additives as discussed above. The wash volume is a sufficient volume of water for facilitating a main wash of the articles, such as for example between approximately 6 gallons and approximately 30 gallons. Step 200 may further include, for example, the step 214 of agitating the articles within the tub 64. For example, agitation element 92 may be operated to agitate the articles, as discussed above. Step 200 may further include, for example, the step 216 of draining water from the tub 64. For example, pump assembly 90 may be utilized to drain water, which may include a substantial portion of the wash volume, from the tub 64. Step 200 may further include, for example, the step 218 of spinning the articles within the tub 64. For example, basket 70 may be spun as discussed above to wring excess water from the articles.

A method 200 according to the present disclosure may further include, for example, the step 220 of performing a rinse cycle. The rinse cycle may in some embodiments follow the main wash cycle. In other embodiments, the rinse cycle may be performed as a stand-along cycle without an initial main wash cycle. The rinse cycle may include various steps for rinsing the articles, to for example ensure that excess additives are removed from the articles. Further, as disclosed herein, a rinse cycle according to the present disclosure may warm the articles, thus facilitating positive perception by users retrieving the articles after the rinse cycle, while allowing the appliance 50 to remain within pertinent energy regulations.

For example, step 220 may include the step 222 of spraying an initial rinse volume of water into the tub 64. The water may be sprayed into the tub 64 through, for example, apertures 79 of nozzle 72. The water may be at a cold temperature. The water temperature may be based on the water source(s) from which the water is obtained for the various require rinse volumes of water. For example, the initial rinse volume of water, at the cold temperature, may in some embodiments be supplied solely from the cold water source 75. The cold temperature may, for example, be between approximately 45 degrees Fahrenheit and approximately 80 degrees Fahrenheit, such as between approximately 55 degrees Fahrenheit and approximately 65 degrees Fahrenheit.

Further, step 220 may include the step 224 of rotating the articles within the tub 64 during the step 222 of spraying the initial rinse volume of water into the tub 64. Either the basket 70 may rotate or the agitation element 92 may rotate, either continuously in one direction, in an oscillating manner, or in a pulsating movement with each pulse spaced apart by periods of no movement. Such rotation may in some embodiments be a relatively slow rotation, such as generally slower than typical agitation during a main wash cycle and typical spinning of the basket 70 to wring excess water from the articles. For example, in some embodiments, rotation may occur at a speed of less than or equal to approximately 20 revolutions per minute ("RPM") such as between approximately 12 RPM and approximately 18 RPM. In other embodiments, rotation may occur at relatively higher speeds, in order to force the sprayed water through the articles to effectuate rinsing. Such rotation may occur at speeds of between approximately 100 RPM and approximately 250 RPM, such as between approximately 120 RPM and 200 RPM. Such various rotational speeds and patterns allow the spray of water to generally contact the articles within the tub 64.

Further, step 220 may include the step 226 of draining water from the tub 64 during and/or after the step 222 of spraying the initial rinse volume of water into the tub 64. For example, pump assembly 90 may be utilized to drain water, which may include a substantial portion of the wash volume, from the tub 64. Still further, step 220 may include the step 228 of spinning the articles within the tub 64 after the step 222 of spraying the initial rinse volume of water into the tub 64, as well as after the step 226 of draining water from the tub 64. For example, basket 70 may be spun as discussed above to wring excess water from the articles. Such spinning may occur at a high rate of speed, such as, for example, at a speed of between approximately 450 RPM and 1200 RPM, or alternatively may occur at another suitable speed, such as at a speed as discussed with respect to step 224.

Notably, in exemplary embodiments, steps 222, 224 and 226 may be performed generally concurrently, and step 226 may then continue to occur during step 228.

Steps 222, 224, 226 and 228 may generally form an initial rinse of the rinse cycle. In some embodiments, one or more subsequent rinses may additionally be performed. Accordingly, step 220 may further include, for example, the step 232 of spraying an intermediate rinse volume of water into the tub 64. The water may be sprayed into the tub 64 through, for example, apertures 79 of nozzle 72. The water may be at a cold temperature, as discussed above with respect to the initial rinse volume of water.

Further, step 220 may include the step 234 of rotating the articles within the tub 64 during the step 232 of spraying the intermediate rinse volume of water into the tub 64. Either the basket 70 may rotate or the agitation element 92 may rotate, either continuously in one direction, in an oscillating manner, or in a pulsating movement with each pulse spaced apart by periods of no movement. Such rotation may in some embodiments be a relatively slow rotation, such as generally slower than typical agitation during a main wash cycle and typical spinning of the basket 70 to wring excess water from the articles. For example, in some embodiments, rotation may occur at a speed of less than or equal to approximately 20 revolutions per minute ("RPM") such as between approximately 12 RPM and approximately 18 RPM. In other embodiments, rotation may occur at relatively higher speeds, in order to force the sprayed water through the articles to effectuate rinsing. Such rotation may occur at speeds of between approximately 100 RPM and approximately 250 RPM, such as between approximately 120 RPM and 200 RPM. Such various rotational speeds and patterns allow the spray of water to generally contact the articles within the tub 64.

Further, step 220 may include the step 236 of draining water from the tub 64 during and/or after the step 232 of spraying the intermediate rinse volume of water into the tub 64. For example, pump assembly 90 may be utilized to drain water, which may include a substantial portion of the wash volume, from the tub 64. Still further, step 220 may include the step 238 of spinning the articles within the tub 64 after the step 232 of spraying the intermediate rinse volume of water into the tub 64, as well as after the step 236 of draining water from the tub 64. For example, basket 70 may be spun as discussed above to wring excess water from the articles. Such spinning may occur at a high rate of speed, such as, for example, at a speed of between approximately 450 RPM and 1200 RPM, or alternatively may occur at another suitable speed, such as at a speed as discussed with respect to step 234.

Notably, in exemplary embodiments, steps 232, 234 and 236 may be performed generally concurrently, and step 236 may then continue to occur during step 238.

Once the initial rinse and, optionally, one or more subsequent rinses have been performed, a final rinse of the rinse cycle may be performed. As discussed herein, the final rinse may be performed using water at a relatively higher temperature, thus warming the articles at the end of the rinse cycle. Thus, users may advantageously experience warm articles at the conclusion of the wash process, while the use of a relatively small amount of higher temperature water only for the final rinse may advantageously allow the washing machine appliance to operate in an energy efficient manner, within the required energy regulations for washing machine appliances 50.

Accordingly, step 220 may further include, for example, the step 242 of spraying a final rinse volume of water into the tub 64. The water may be sprayed into the tub 64 through, for example, apertures 79 of nozzle 72. The water may be at a temperature greater than the cold temperature utilized during the initial and optional subsequent rinses. As mentioned, the water temperature may be based on the water source(s) from which the water is obtained for the various require rinse volumes of water. For example, the final rinse volume of water, at the temperature greater than the cold temperature, may in some embodiments be supplied solely from the hot water source 76 or in other embodiments be supplied from the hot water source 76 and the cold water source 75. The temperature may, for example, be a warm temperature between approximately 80 degrees Fahrenheit and approximately 110 degrees Fahrenheit, such as between approximately 85 degrees Fahrenheit and approximately 95 degrees Fahrenheit. In such warm temperature embodiments, the water may typically be supplied from the hot water source 76 and the cold water source 75, and combined at, for example, valve 74 to form water at the warm temperature. In other embodiments, the temperature may, for example, be a hot temperature between approximately 110 degrees Fahrenheit and approximately 160 degrees Fahrenheit, such as between approximately 130 degrees Fahrenheit and approximately 140 degrees Fahrenheit. In such hot temperature embodiments, the water may typically be supplied solely from the hot water source 76.

Further, step 220 may include the step 244 of rotating the articles within the tub 64 during the step 242 of spraying the final rinse volume of water into the tub 64. Either the basket 70 may rotate or the agitation element 92 may rotate, either continuously in one direction, in an oscillating manner, or in a pulsating movement with each pulse spaced apart by periods of no movement. Such rotation may in some embodiments be a relatively slow rotation, such as generally slower than typical agitation during a main wash cycle and typical spinning of the basket 70 to wring excess water from the articles. For example, in some embodiments, rotation may occur at a speed of less than or equal to approximately 20 revolutions per minute ("RPM") such as between approximately 12 RPM and approximately 18 RPM. In other embodiments, rotation may occur at relatively higher speeds, in order to force the sprayed water through the articles to effectuate rinsing. Such rotation may occur at speeds of between approximately 100 RPM and approximately 250 RPM, such as between approximately 120 RPM and 200 RPM. Such various rotational speeds and patterns allow the spray of water to generally contact the articles within the tub 64.

Further, step 220 may include the step 246 of draining water from the tub 64 after the step 242 of spraying the final rinse volume of water into the tub 64. For example, pump assembly 90 may be utilized to drain water, which may include a substantial portion of the wash volume, from the tub 64. Still further, step 220 may include the step 248 of spinning the articles within the tub 64 after the step 242 of spraying the final rinse volume of water into the tub 64, as well as after the step 246 of draining water from the tub 64. For example, basket 70 may be spun as discussed above to wring excess water from the articles. Such spinning may occur at a high rate of speed, such as, for example, at a speed of between approximately 450 RPM and 1200 RPM, or alternatively may occur at another suitable speed, such as at a speed as discussed with respect to step 224.

Notably, in exemplary embodiments, steps 242, 244 and 246 may be performed generally concurrently, and step 246 may then continue to occur during step 248.

The amount of water utilized during a rinse cycle, and particularly during a final rinse, in accordance with the present disclosure may be relatively minimal. This may advantageously allow the appliance 50 to remain energy efficient and within the required regulations while utilizing relatively warmer water for the final rinse. For example, in some embodiments, a total rinse volume of water utilized during the rinse cycle may be between approximately 2 gallons and approximately 10 gallons, such as between approximately 3 gallons and approximately 8 gallons. The total rinse volume of water may be the total of the initial rinse volume of water, the final rinse volume of water, and any intermediate rinse volumes of water. Further, in some embodiments, the final rinse volume of water may be between approximately 0.5 gallons and approximately 3 gallons. Accordingly, a relatively minimal amount of water is utilized to provide a user with warm articles at the conclusion of the washing process.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance having a tub and a basket rotatably mounted within the tub, the basket defining a chamber for receipt of articles for washing, the method comprising:

flowing a wash volume of water into the tub, the wash volume of water between approximately 6 gallons and approximately 30 gallons;

draining a substantial portion of the wash volume of water from the tub;

spraying a total rinse volume of water into the tub after draining the substantial portion of the wash volume from the tub, the total rinse volume including an initial rinse volume of water and a final rinse volume of water, the initial rinse volume of water at a cold temperature between approximately 45 degrees Fahrenheit and approximately 80 degrees Fahrenheit and the final rinse volume of water at a temperature greater than the cold temperature and between approximately 80 degrees Fahrenheit and approximately 160 degrees Fahrenheit;

rotating the articles within the tub during the step of spraying the total rinse volume of water into the tub; and spinning the articles within the tub after the step of spraying the total rinse volume of water into the tub;

wherein the total rinse volume of water is between approximately 2 gallons and approximately 8 gallons.

2. The method of claim 1, wherein the step of rotating the articles within the tub is performed at speeds of less than or equal to approximately 20 revolutions per minute.

3. The method of claim 1, wherein the step of rotating the articles within the tub is performed at speeds of between approximately 100 revolutions per minute and approximately 250 revolutions per minute.

4. The method of claim 1, wherein the step of spinning the articles within the tub is performed at speeds of between approximately 450 revolutions per minute and approximately 1200 revolutions per minute.

5. The method of claim 1, further comprising agitating the articles within the tub after flowing the wash volume of water into the tub.

6. A washing machine appliance, comprising:

a tub;

a basket rotatably mounted within the tub, the basket defining a wash chamber for receipt of articles for washing;

a main valve in fluid communication with an external water source;

a nozzle configured for flowing water from the valve into the tub;

a motor in mechanical communication with the basket, the motor configured for selectively rotating the basket within the tub; and a controller in operative communication with the valve and the motor, the controller operable for:

flowing a wash volume of water into the tub, the wash volume of water between approximately 6 gallons and approximately 30 gallons;

draining a substantial portion of the wash volume from the tub;

spraying a total rinse volume of water into the tub after draining the substantial portion of the wash volume from the tub, the total rinse volume including an initial rinse volume of water and a final rinse volume of water, the initial rinse volume of water at a cold temperature between approximately 45 degrees Fahrenheit and approximately 80 degrees Fahrenheit and the final rinse volume of water at a temperature greater than the cold temperature and between approximately 80 degrees Fahrenheit and approximately 160 degrees Fahrenheit;

rotating the articles within the tub during the step of spraying the total rinse volume of water into the tub;

spinning the articles within the tub after the step of spraying the total rinse volume of water into the tub;

wherein the total rinse volume of water is between approximately 2 gallons and approximately 8 gallons.

7. The washing machine appliance of claim 6, wherein the main valve is in fluid communication with a plurality of external water sources, the plurality of external water sources comprising a cold water source and a hot water source.

8. The washing machine appliance of claim 7, wherein the initial rinse volume of water is supplied solely from the cold water source.

9. The washing machine appliance of claim 7, wherein the final rinse volume of water is supplied solely from the hot water source.

10. The washing machine appliance of claim 7, wherein the final rinse volume of water is supplied from the cold water source and the hot water source.

11. A method for operating a washing machine appliance, the washing machine appliance having a tub and a basket rotatably mounted within the tub, the basket defining a chamber for receipt of articles for washing, the method comprising:

performing a main wash cycle comprising:

flowing a wash volume of water into the tub, the wash volume of water between approximately 6 gallons and approximately 30 gallons;

agitating the articles within the tub, and draining a substantial portion of the wash volume of water from the tub; and performing a rinse cycle following the main wash cycle, the rinse cycle comprising:

spraying an initial rinse volume of water into the tub, the water at a cold temperature between approximately 45 degrees Fahrenheit and approximately 80 degrees Fahrenheit, spraying a final rinse volume of water into the tub after spraying the initial rinse volume of water into the tub, the final rinse volume of water at a temperature greater than the cold temperature and between approximately 80 degrees Fahrenheit and approximately 160 degrees Fahrenheit, rotating the articles within the tub during the step of spraying the initial rinse volume of water into the tub and during the step of spraying the final rinse volume of water into the tub, and spinning the articles within the tub after the step of spraying the final rinse volume of water into the tub, wherein a total rinse volume of water utilized during the rinse cycle includes the initial rinse volume and the final rinse volume and is between approximately 2 gallons and 8 gallons, and wherein the steps of rotating the articles within the tub are performed at speeds of between approximately 12 revolutions per minute and 18 revolutions per minute.

* * * * *